US006745653B2

(12) United States Patent
Kurtz et al.

(10) Patent No.: US 6,745,653 B2
(45) Date of Patent: Jun. 8, 2004

(54) ADJUSTABLE THROTTLE PEDAL DEPRESSOR

(75) Inventors: Scotty R. Kurtz, Clarinda, IA (US); Kevin L. Tally, Clarinda, IA (US)

(73) Assignee: The Lisle Corporation, Clarinda, IA (US)

( * ) Notice: Subject to any disclaimer, the term of this patent is extended or adjusted under 35 U.S.C. 154(b) by 84 days.

(21) Appl. No.: 10/273,278

(22) Filed: Oct. 17, 2002

(65) Prior Publication Data

US 2004/0035265 A1 Feb. 26, 2004

Related U.S. Application Data

(63) Continuation-in-part of application No. 10/223,825, filed on Aug. 20, 2002.

(51) Int. Cl.[7] ..... B25B 33/00

(52) U.S. Cl. ..... 81/488; 81/177.2; 269/167; 254/DIG. 5

(58) Field of Search ..... 87/177.2, 488, 87/489; 269/166, 167; 254/DIG. 5

(56) References Cited

U.S. PATENT DOCUMENTS

| | | | | | |
|---|---|---|---|---|---|
| 1,681,192 | A | * | 8/1928 | McBride | 254/DIG. 5 |
| 2,866,356 | A | * | 12/1958 | Elam | 254/DIG. 5 |
| 4,957,257 | A | * | 9/1990 | Gonzalez | 269/167 |
| 5,238,213 | A | | 8/1993 | Pool | |
| 5,427,364 | A | * | 6/1995 | Zborschil | 269/166 |
| 5,583,288 | A | | 12/1996 | Brenner et al. | |
| 6,079,703 | A | * | 6/2000 | Chavez, Jr. | 269/166 |
| 6,202,519 | B1 | * | 3/2001 | Yandt | 81/488 |
| 6,279,418 | B1 | * | 8/2001 | Olive, Jr. | 254/DIG. 5 |
| 2001/0045124 | A1 | | 11/2001 | Mouck et al. | |

OTHER PUBLICATIONS

Pedal Pusher, Segle Products, Inc., Ontario, Canada.
Pedal Pusher, No. J 39610, Kent–Moore.
Universal Throttle Pedal Depressor, No. 393, Thexton Catalog.
Steering Wheel Holder, No. WA96A and Brake and Accelerator Pedal Jack, No. B240A, Snap–On Catalog, p. E70.
Pedal Press, No. PP29 and Universal Throttle Depressor, No. 393, Matco Tools Catalog.
Invention Disclosure Agreement with Richard Ferraro, Air Operated Cylinder.
Invention Disclosure Agreement with Charles J. Pastor, Truck Clutch Adjustment Tool.
Invention Disclosure Agreement with Roy July Flores, Clutch Adjustment tool.
Invention disclosure Agreement with Israel Garza, Clutch Adjusting tool.
Invention Disclosure Agreement with Robert Koivisto, Heavy Duty Clutch Adjustment and Cam Brake Adjustment Tool.
Invention Disclosure Agreement with Steven Bauer, Clutch Adjustment and Clutch Brake Installation Tool.
Invention Disclosure Agreement with Robert Love, Warmer Upper.
Invention Disclosure Agreement with Talley Neely, III, Brake and Accelerator Pedal Jack.
Invention Disclosure Agreement with C. R. Wooster, Brake and Accelerator Pedal Hold Down tool.
Invention Disclosure Agreement with Jeff Milliff, Telescoping Mechanic's Crutch.

(List continued on next page.)

*Primary Examiner*—James G. Smith
(74) *Attorney, Agent, or Firm*—Banner & Witcoff, Ltd.

(57) ABSTRACT

A throttle pedal depressor for a vehicle includes an adjustable hook and locking plate for maintaining the hook in a fixed position on a shaft. A rubber tip is provided at one end of the shaft for engaging a pedal and a screw assembly is rotatably adjustable to provide fine adjustment.

1 Claim, 2 Drawing Sheets

OTHER PUBLICATIONS

Invention Disclosure Agreement with Joe Brown, Device to Run Engines at Fast Idle.
Invention Disclosure Agreement with Edward Brummitt, Telescoping rod that Pushes on a Gas Pedal.
Invention Disclosure Agreement with Todd S. Peters, Tool for Depressing the Foot Feed Clutch or Brake Pedals.
Invention Disclosure Agreement with Joe Mitchel, Accelerator Pedal.
Invention Disclosure Agreement with Juan Caballero, Telescoping Tool to Depress Throttle Pedal.
Invention Disclosure Agreement with John Schaffner, (The Assistant) Throttle Controlling Device.

* cited by examiner

ADJUSTABLE THROTTLE PEDAL DEPRESSOR

CORSS REFERENCE TO RELATED APPLICATION

This is a continuation in part of application Ser. No. 10/223,825 filed Aug. 20, 2002 for a VEHICLE PEDAL DEPRESSOR for which a priority is claimed and which is incorporated herein by reference.

BACKGROUND OF THE INVENTION

In a principal aspect, the present invention relates to an adjustable throttle pedal depressor for use with vehicles to facilitate service and repair of such vehicles by engaging and maintaining a throttle pedal in a depressed and fixed position.

When servicing vehicles, it is often necessary to check systems, such as the fuel or throttle control system. When engaged in such efforts, it may be necessary to depress the throttle or accelerator pedal or other pedals within the vehicle and to maintain the depressed pedal in a fixed position while attending to repair of the vehicle. Proposals have been made to use a pedal depressor which will engage a portion of the vehicle, for example, the steering wheel, and provide a brace between the steering wheel and the accelerator pedal or the like. Various devices have been proposed for accomplishing such an objective.

While such a mechanism may be useful, there has remained the need to provide for an easily adjustable mechanism which may be engaged with not only a steering wheel, but also with other contact points in order to maintain a throttle pedal in a highly controlled, adjustable and depressed position. Such a device should be easily adjustable, compact and simple to use, yet adequately rugged for usage with vehicles.

BRIEF DESCRIPTION OF THE INVENTION

Briefly, the present invention comprises an elongate shaft with a slidable hook. The shaft includes a projecting tip at one end that may be fitted against a vehicle throttle or accelerator pedal. The tip of the shaft includes an elastomeric, non-slip, socket member which may engage against the pedal. The hook, which is slidably mounted on the shaft, may be braced against the steering wheel of the vehicle. A locking plate mounted on the shaft engages and maintains the slidable hook in a coarsely adjusted position relative to the tip end of the shaft. An adjusting screw assembly connects the locking plate with the hook and may be adjusted to finely position the hook relative to the tip end of the shaft. A biasing member is positioned intermediate the hook and locking plate. Thus the hook may be fitted against a steering wheel by releasing the locking plate manually while engaging the tip of the shaft against a throttle pedal. The locking plate may then be canted and engaged with the shaft to hold the attached hook in place. Subsequently the screw assembly may be utilized to further and finely adjust the position of the hook on the shaft and thus the accelerator pedal position.

Thus, it is an object of the invention to provide an improved, adjustable pedal depressor for vehicles, particularly useful for maintaining a throttle pedal in a depressed position during servicing and repair work.

It is a further object of the invention to provide an adjustable length pedal depressor especially designed to maintain engagement with a pedal at one end and a steering wheel at the opposite end.

Yet another object of the invention is to provide an adjustable pedal depressor which can be easily adjusted to maintain a fixed and desired length with a minimum of manual adjustment.

A further object of the invention is to provide an adjustable pedal depressor which is economical, rugged, easy to use, and sized so as not to interfere with a maintenance or servicing operation.

Another object of the invention is to provide a throttle pedal depressor which includes a coarse adjustment and a fine adjustment mechanism for control or precise positioning of the throttle pedal of a vehicle.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
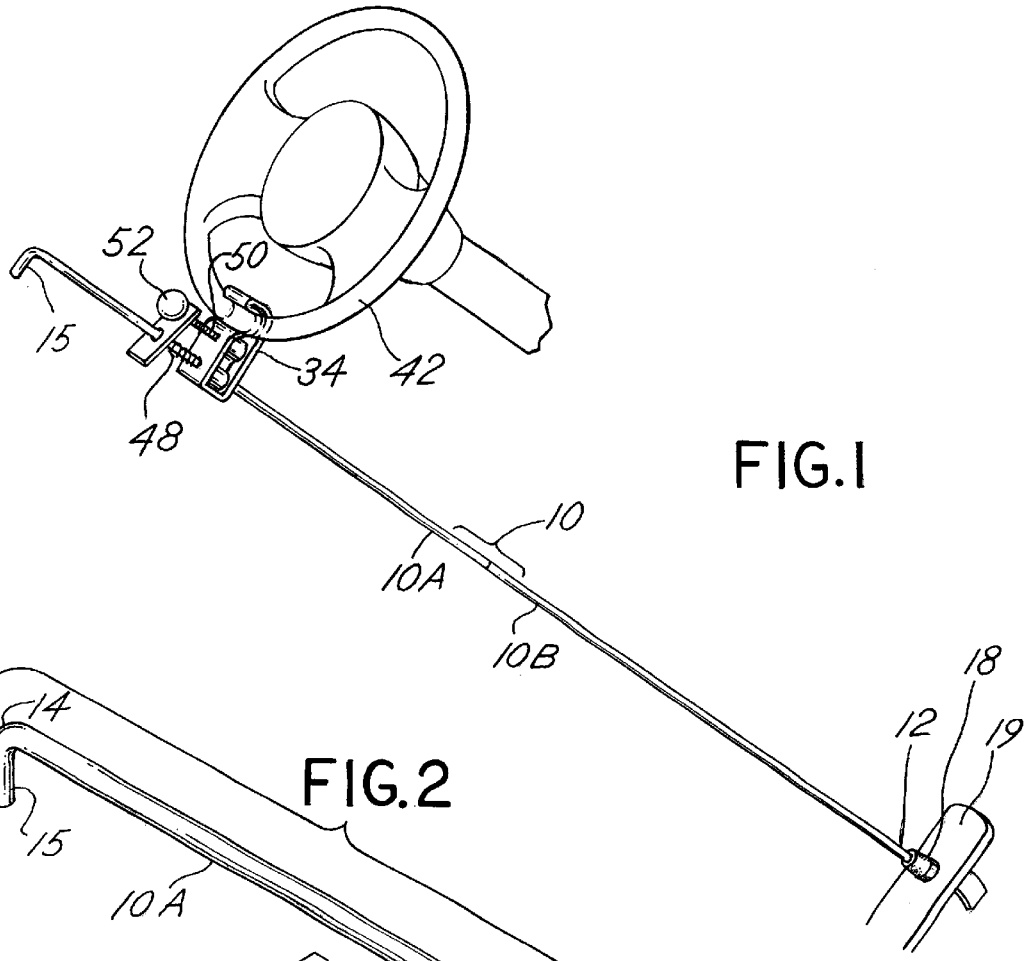
FIG. 1 is an isometric view depicting the adjustable pedal depressor of the invention in position engaging a pedal at one end and against a steering wheel of a vehicle at the opposite end.
Figure 2:
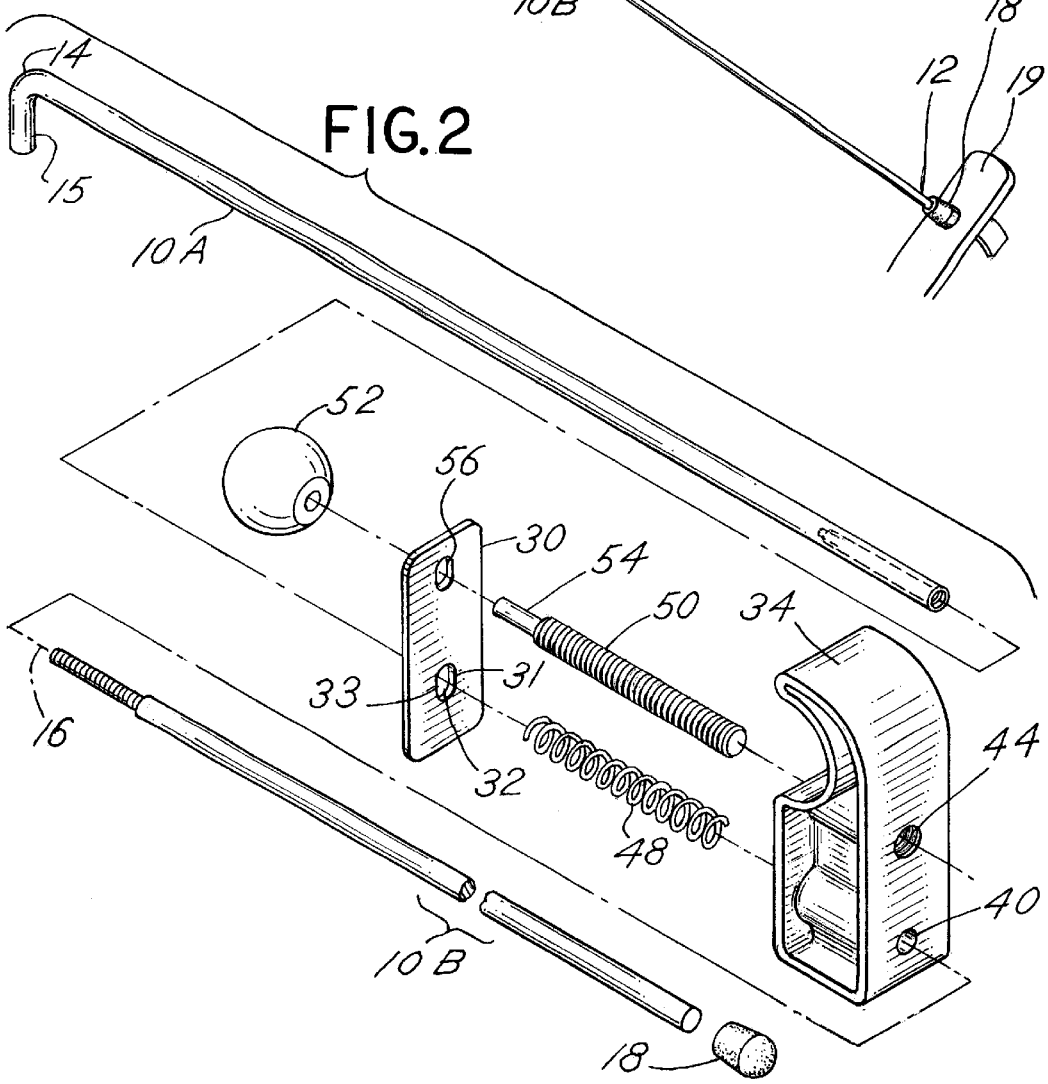
FIG. 2 is an exploded isometric view of the pedal depressor depicted in FIG. 1.
Figure 3:
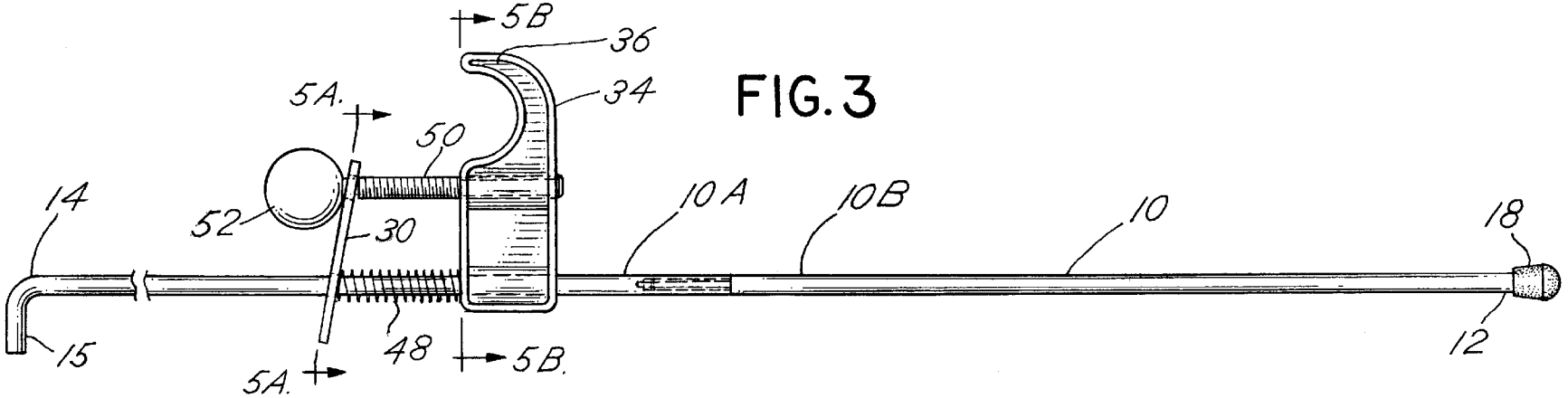
FIG. 3 is a side elevation view of the pedal depressor of FIG. 2.
Figure 4:
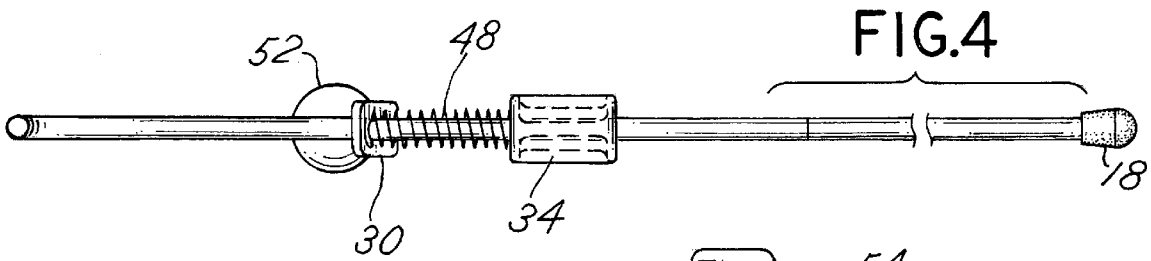
FIG. 4 is a bottom elevation view of the pedal depressor of FIG. 3.

Referring to the figures, the pedal depressor of the invention is comprised of a first elongate tube or shaft 10 which, in the embodiment depicted, is a cylindrical tubular member or rod having a pedal engaging end 12 and an opposite end 14 with an L-shaped bend 15. In the preferred embodiment, the shaft 10 is comprised of threadably connected sections 10A and 10B which enable the product to be disassembled for packaging or storage in a compact manner.

An elastomeric tip or socket 18 comprised of a non-skid material is fitted over the pedal engaging end 12. Thus, the tip or socket 18 includes a counterbore into which the pedal engaging end 12 of shaft 10 is fitted. The socket or tip 18 is preferably made from an elastomeric material or rubber in order to increase the frictional interaction thereof with a pedal 19 against which the tip 18 is placed during use of the device. Also, the tip 18 is generally rounded along its bottom face or surface 21. However, various shapes and configurations may be utilized to enhance gripping action of tip 18 with a pedal 19.

Figure 5B:
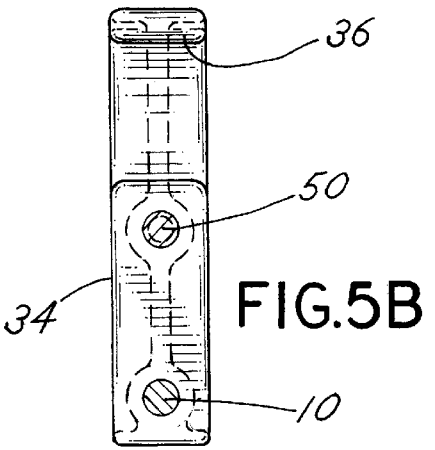
FIG. 5 is a plan view of the locking plate and screw assembly for the pedal depressor of FIG. 1.
Figure 5A:
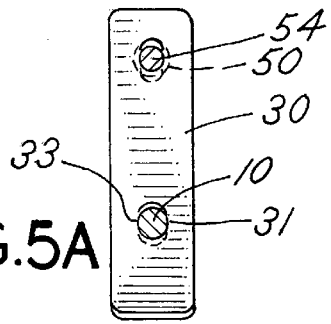

A manually actuated locking plate 30, depicted in plan view in FIG. 5, is positioned on shaft 10. Plate 30 includes an opening 32 having a configuration which enables sliding movement on shaft 10 when plate 30 is oriented radially with respect to the longitudinal axis 15 of shaft 10. The opening 32 further enables the plate 30 to be canted away from tip 18 and thereby frictionally fixed or held in position on shaft 10 due to interaction of the sides 31, 33 of opening 32 with shaft 10.

A slidable hook 34 is also mounted on the shaft 10. The hook 34 includes a hook member 36 and a body section 38 with a cylindrical passage 40 therethrough for receipt of the shaft 10. The body member 38 projects radially from the longitudinal axis of the shaft 10 and terminates with the hook member 36 that is curved or shaped so as to appropriately engage with a steering wheel of a vehicle namely, steering wheel 42. The hook 34 further includes a threaded passage 44 intermediate the passage 40 and the hook member 36.

A compression spring 48 is positioned on the shaft 10 intermediate the hook 34 and the plate 30. The compression spring 48 provides a biasing force against the plate 30 which will tend to cant the plate 30 so as to engage with the shaft 10.

A screw assembly comprised of a threaded shaft 50 having a knob 52 at one end further provides a means to effect canting of the plate 30 in combination with the shaft 10. The shaft 50 is threaded and includes a reduced diameter section 54 adjacent the knob 52. The reduced diameter section 54 of the threaded shaft 50 fits through an opening 56 at the outer end of the plate 30. The shaft 50 is threadably inserted into the threaded passage 44 of the hook 34. Thus by rotating the knob 52, the shaft 50 may be rotated thereby controlling the length of the spacing between the hook 34 and the locking plate 30 by effecting movement of hook 34 on shaft 10.

The operation of the device provides a means for a coarse adjustment of the position of the hook 34 on the shaft 10 and further includes a means for a fine adjustment of the position of the hook 34 on the shaft 10. Thus in order to position the device, the tip 18 is placed against a throttle pedal. For example, as shown in FIG. 1 a throttle pedal 19 is engaged by tip 18. Thereafter the plate 30 is manually moved against the force of the compression spring 48. In this manner the plate 30 is positioned on a radius extending from the axis of the shaft 10. As a result, the hook 34 may slide on the shaft 10 to a position engaging steering wheel 42. The plate 30 is then released manually and caused to engage or assume a canted position thereby holding the hook 34 in position against the steering wheel 42. Thereafter the hook 34 may be further adjusted by rotating the knob 52. This will cause the shaft 50 to rotate thereby moving the hook 34 along the shaft 10 depending upon the direction of rotation of the knob 52 and shaft 50. In this manner, a fine adjustment of the position of the hook 34 relative to the tip 18 may be provided. Thus the amount of movement or depression of the throttle pedal 19 may be finely controlled and precisely controlled.

It will be noted that the shaft 10 includes a portion 15 which is L-shaped to prevent loss or removal of the component parts including the plate 30 and hook 34 from the shaft 10. The tip member 18 prevents removal of those component parts from the opposite end of the shaft 10.

In a preferred embodiment the shaft 10 is cylindrical though other configurations may be used in order to key the plate 30 and hook 34 to the shaft 10. Additionally, the coil compression spring 48 is depicted on the shaft 10 intermediate the hook 34 and plate 30. Various other biasing means or spring mechanisms may be utilized. The shape of the knob 52 may also be varied. Various other modifications may be made to the device without departing from the spirit and scope of the invention. Thus the invention is to be limited only by the following claims and equivalents thereof.

What is claimed is:

1. A pedal depressor for engaging and maintaining a throttle pedal at an adjusted depressed position comprising, in combination:

an elongate shaft having a pedal engagement end;

a hook bracket slidably mounted on the shaft and spaced from the pedal end, said bracket projecting radially from the shaft and including a hook radially spaced from the shaft;

a locking plate slidably mounted on the shaft, said plate including a shaft opening for slidable movement of the shaft, said opening being oversized relative to the cross section of the shaft to accommodate canting of the plate on the shaft to a non-slidable position;

a biasing member simultaneously engaging the hook bracket and plate for separating the hook bracket and plate by imparting a force therebetween;

a screw assembly adjustably connecting the locking plate and hook bracket, said plate including a second opening for receipt of the screw assembly, said second opening radially spaced from the shaft;

said plate releasable from the non-slidable position by manual movement of the plate from a canted position toward a non-canted position, said hook being coarsely positioned from the pedal engagement end of the shaft by sliding movement on the shaft with the plate, said hook being finely adjusted by sliding movement on the shaft independently from the plate upon adjustment of the screw assembly.

* * * * *